US006698701B1

(12) United States Patent
Dalton

(10) Patent No.: US 6,698,701 B1
(45) Date of Patent: Mar. 2, 2004

(54) ELECTRONIC SHELF LABEL MOUNTING APPARATUS

(75) Inventor: Gary C. Dalton, Snellville, GA (US)

(73) Assignee: NCR Corporation, Dayton, OH (US)

( * ) Notice: Subject to any disclaimer, the term of this patent is extended or adjusted under 35 U.S.C. 154(b) by 40 days.

(21) Appl. No.: 09/713,607

(22) Filed: Nov. 15, 2000

(51) Int. Cl.[7] ..... A47B 96/00

(52) U.S. Cl. ..... 248/222.12; 248/225.11; 248/27.3; 40/642.02

(58) Field of Search ..... 248/222.12, 222.14, 248/225.11, 217.3, 222.11, 27.1, 27.3; 40/642.02, 661.03, 651

(56) References Cited

U.S. PATENT DOCUMENTS 3,015,177 A * 1/1962 Hembd et al.
3,711,973 A * 1/1973 Slavsky
3,793,563 A * 2/1974 Brefka ..... 361/627
4,812,133 A * 3/1989 Fleak et al. ..... 439/248
4,881,707 A * 11/1989 Garfinkle
5,553,412 A * 9/1996 Briechle et al.
5,611,512 A * 3/1997 Cholet
5,791,080 A * 8/1998 Hamano
5,816,550 A * 10/1998 Watanabe et al.
6,000,611 A * 12/1999 Dalton et al.
6,119,990 A * 9/2000 Kump et al.
6,142,322 A * 11/2000 Smith et al.
6,189,248 B1 * 2/2001 Nagel et al.
6,367,752 B1 * 4/2002 Forsythe et al. ..... 248/220.21

FOREIGN PATENT DOCUMENTS

JP 2001-31221 * 11/2001

* cited by examiner

*Primary Examiner*—Korie Chan
(74) *Attorney, Agent, or Firm*—Paul W. Martin

(57) ABSTRACT

A mounting apparatus for an electronic shelf label which is easy to install. The mounting apparatus includes a frame member defining an aperture through which an electronic shelf label is inserted having a top edge and a bottom edge, a bottom member extending behind the frame member from the bottom edge and including first teeth, and a top member extending behind the frame member from the top edge and including second teeth.

7 Claims, 4 Drawing Sheets

ELECTRONIC SHELF LABEL MOUNTING APPARATUS

BACKGROUND OF THE INVENTION

The present invention relates to electronic shelf label (ESL) systems, and more specifically to an electronic shelf label mounting apparatus.

ESL systems typically include a plurality of ESLs for merchandise items in a transaction establishment. ESLs typically display the price of corresponding merchandise items on store shelves and are typically attached to a rail along the leading edge of the shelves. A transaction establishment may contain thousands of ESLs to display the prices of the merchandise items. The ESLs are coupled to a central server from where information about the ESLs is typically maintained in an ESL data file. Price information displayed by the ESLs is obtained from a price look-up (PLU) data file and stored within an ESL price change record.

ESLs are typically mounted to a channel along a shelf edge, either in an attached rail or in the shelf itself. The fact that there are many different types of shelving and rails present problems for those who install ESLs. Some shelves do not have channels. Some mounts require that ESLs be installed after mounting.

Therefore, it would be desirable to provide an ESL mounting apparatus which securely mounts an ESL to shelves with or without channels and which is easy to install.

SUMMARY OF THE INVENTION

In accordance with the teachings of the present invention, an electronic shelf label (ESL) mounting apparatus is provided.

The mounting apparatus includes a frame member defining an aperture through which an electronic shelf label is inserted having a top edge and a bottom edge, a bottom member extending behind the frame member from the bottom edge and including first teeth, and a top member extending behind the frame member from the top edge and including second teeth.

It is accordingly an object of the present invention to provide an ESL mounting apparatus.

It is another object of the present invention to provide an ESL mounting apparatus which securely retains an ESL.

It is another object of the present invention to provide an ESL mounting apparatus which securely mounts an ESL to shelves with or without channels.

It is another object of the present invention to provide an ESL mounting apparatus which fits within channels of most types of shelves and rails available today.

It is another object of the present invention to provide an ESL mounting apparatus which is easy to install.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENTS

Figure 1:
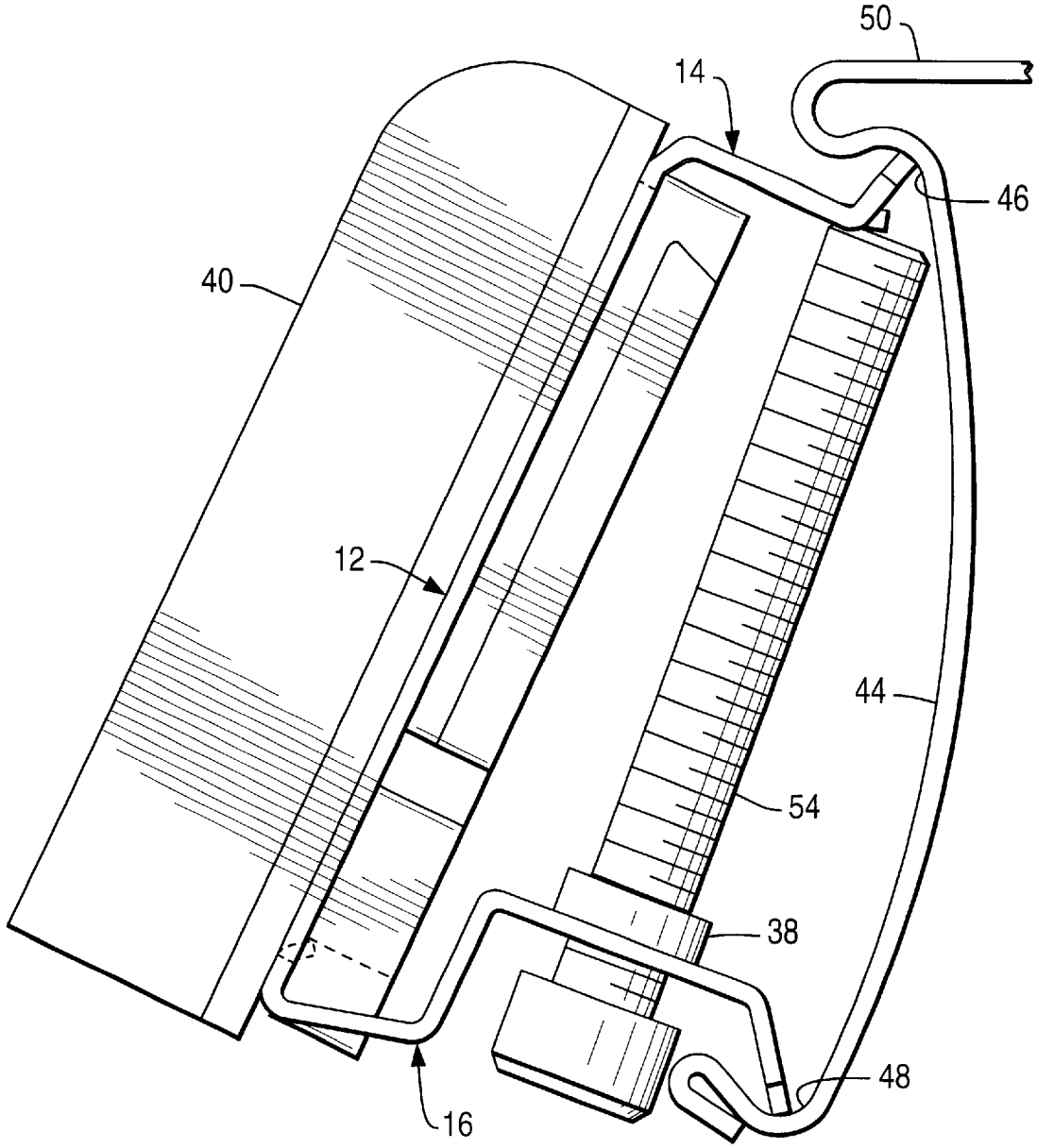
FIG. 1 is a side view of the ESL mounting apparatus attached to a channel.
Figure 2:
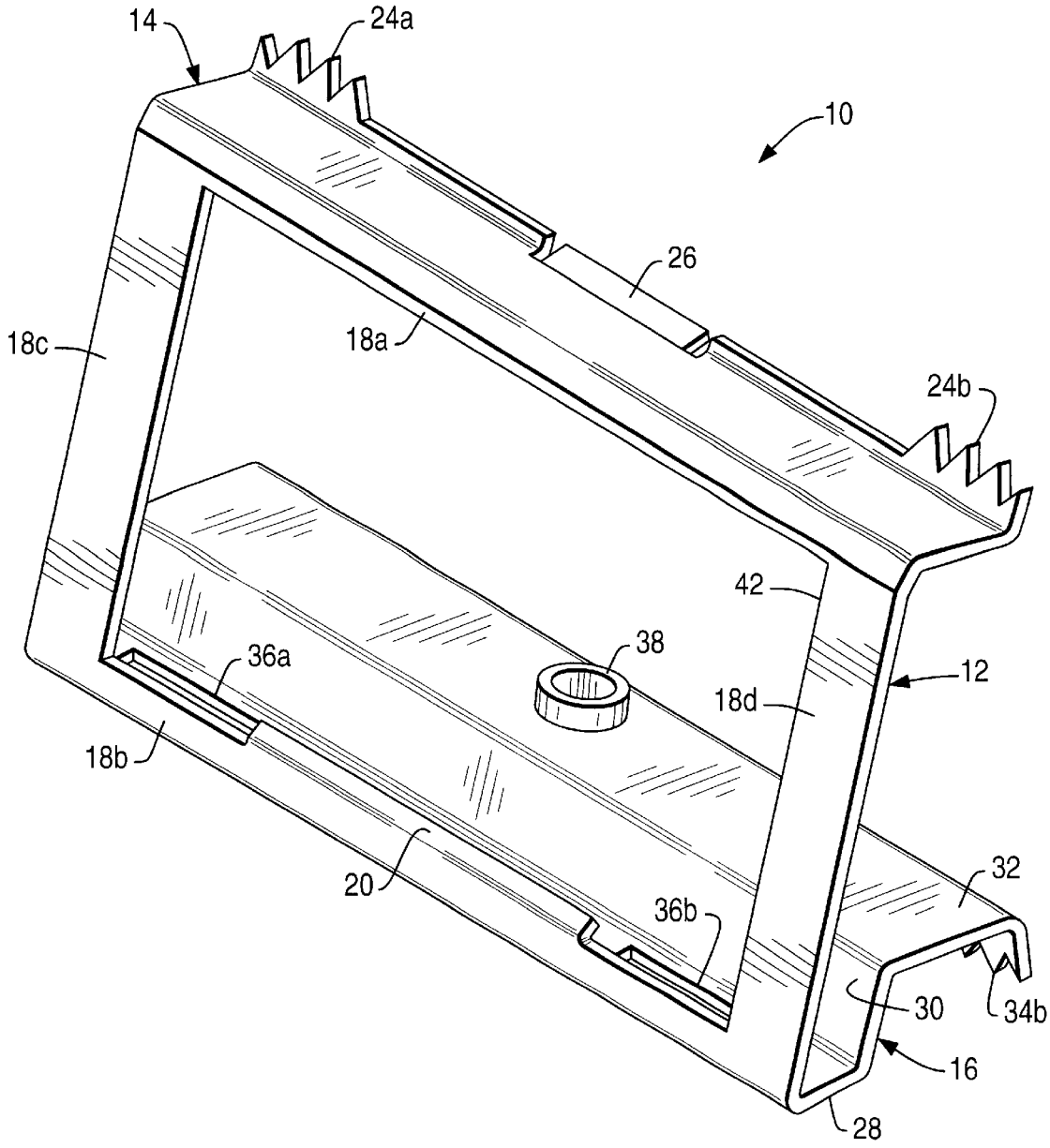
FIG. 2 is a front perspective view of the ESL mounting apparatus.
Figure 3:
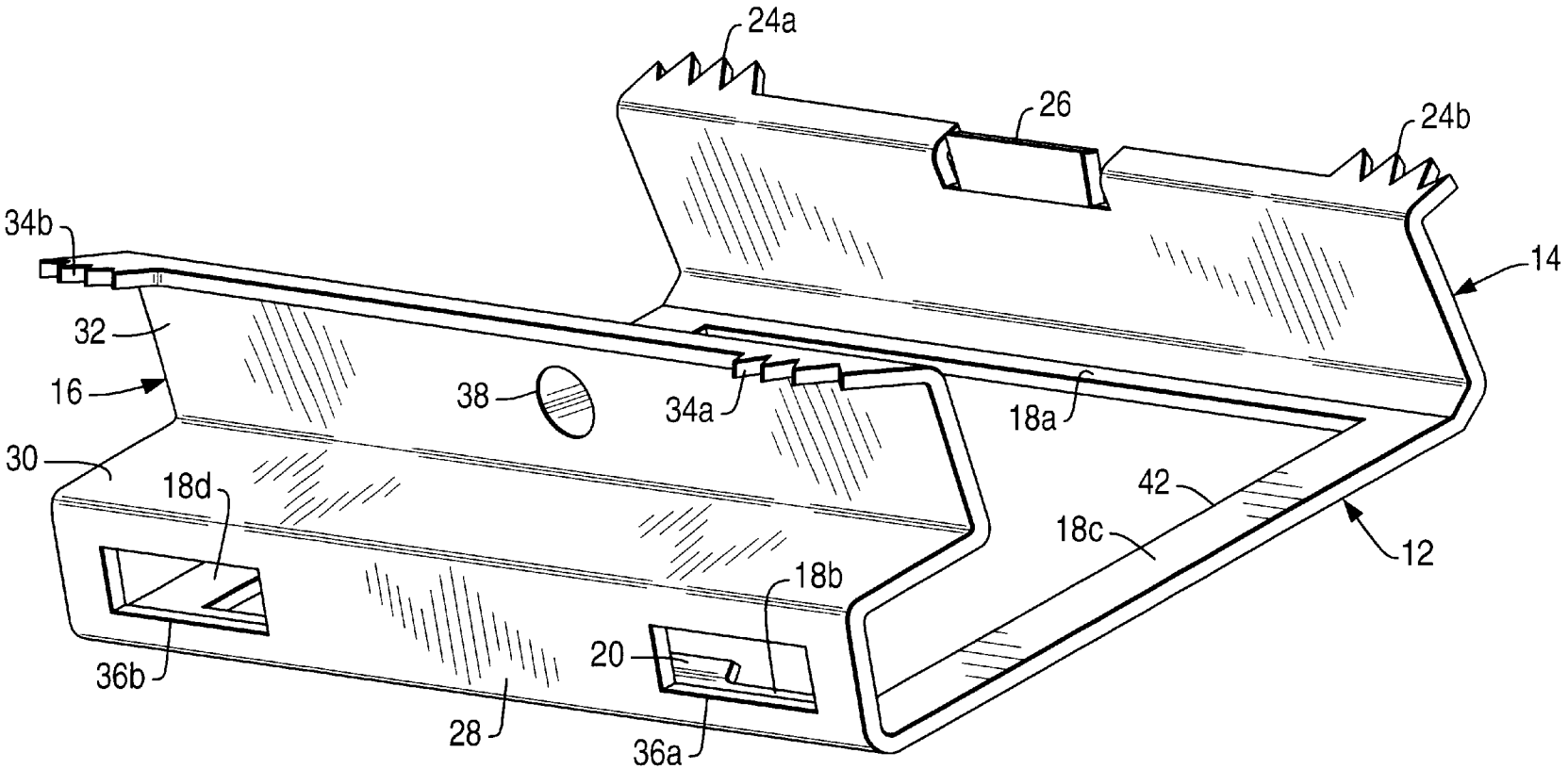
FIG. 3 is a bottom perspective view of the ESL mounting apparatus.

Referring now to FIGS. 1–4, ESL mounting apparatus 10 primarily includes frame portion 12, top portion 14, and bottom portion 16.

Frame portion 12 includes wall portions 18*a–d*. Wall portions 18*a–d* retains ESL 40 through aperture 42. Wall portion 18*b* includes lip 20, which provides a bottom support for spring members 78 and 80 of ESL 40.

Top portion 14 extends from frame portion 12 into shelf channel 44. Top portion 14 establishes an inward travel limit for ESL mounting apparatus 10. Top portion 14 includes teeth portions 24*a* and 24*b*, which are upwardly bent to fit within top corner 46 of channel 44. Top portion 14 also includes tab portion 26 which provides a stop for screw 54.

Bottom portion 16 extends from frame portion 12 into shelf channel 44. Bottom portion 16 establishes an inward travel limit for ESL mounting apparatus 10 and facilitates installation of mounting apparatus into channel 44.

Bottom portion 16 includes first inward extending portion 28, upward extending portion 30, second inward extending portion 32, and teeth portions 34*a* and 34*b*.

First inward extending portion 28 includes apertures 36*a* and 36*b* through which latches 82 and 84 of ESL 40 extend. First inward extending portion 28 is wide enough to allow upward extending portion 30 to pass behind ESL 40, so as not to obstruct ESL 40 during insertion of ESL 40 into frame portion 12.

Teeth portions 34*a* and 34*b* are downwardly bent to fit within bottom corner 48 of channel 44. Bottom portion 16 easily flexes upward to allow teeth portions 34*a* and 34*b* to enter channel 44.

Second inward extending portion 32 includes threaded aperture 38 through which screw 54 extends. When fully inserted, screw 54 presses against tab portion 26 of top portion 14. This pressure forces top portion 14 away from bottom portion 16 and securely engages pairs of teeth portions 24*a*, 24*b* and 34*a*, 34*b* into top and bottom corners 46 and 48, respectively.

While a shelf channel mounting arrangement has been illustrated, other mounting arrangements are also envisioned. Teeth portions 24*a*, 24*b* and 34*a*, 34*b* also facilitate mounting of ESL 40 to shelves which have no channel 44 or channels with small corners 46 and 48.

The illustrated embodiment places ESL 40 in a generally upwardly facing position, suitable for mid to lower shelves 50. However, bottom portion 16 may have more or less width in order to implement different viewing angles.

ESL mounting apparatus 10 is preferably die-cut from steel sheet metal for strength and then bent to shape. Mounting apparatus 10 is flexible enough to be inserted, but is rigid enough to remain in place within channel 44.

With reference to FIG. 1, a first mounting arrangement within a shelf channel 44 is illustrated. Attachment of mounting apparatus 10 to shelf 50 is straightforward. Teeth portions 24*a* and 24*b* are first inserted into corner 46. ESL mounting apparatus 10 is then rotated inwardly towards shelf 50. Collapsing pressure is applied to bottom frame portion 16 so that teeth portions 34*a* and 34*b* may be inserted into corner 48. Screw 54 is tightened to securely retain mounting apparatus in channel 44.

Removal of mounting apparatus 10 proceeds in an opposite fashion.

ESL 40 is inserted before mounting apparatus 10 is affixed to channel 44. ESL 40 is inserted and secured in a manner discussed below.

Figure 4:
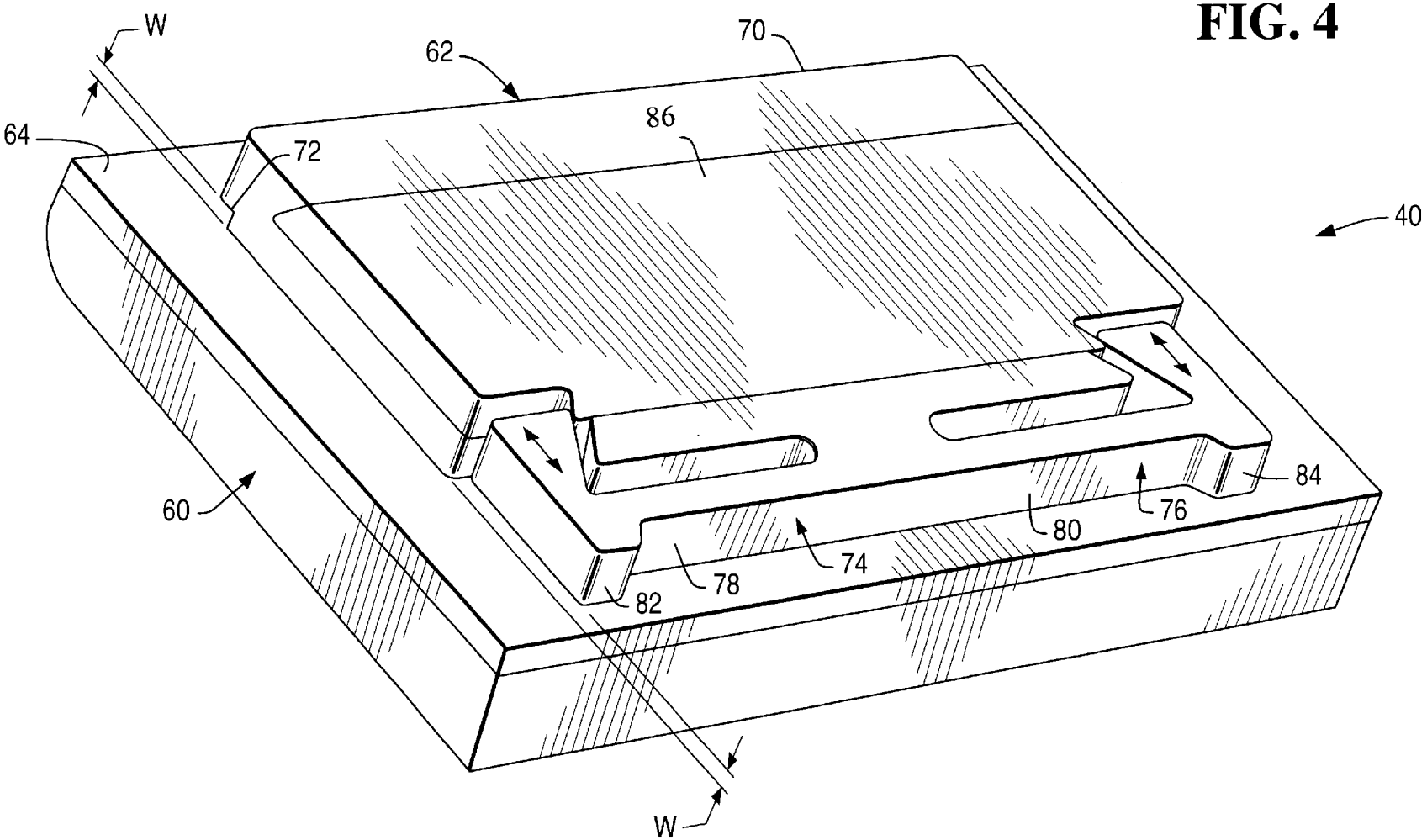
FIG. 4 is a rear perspective view of an ESL which uses the mounting apparatus.

Referring now to FIG. 4, ESL 40 is shown in more detail.

ESL 40 includes main portion 60 and battery storage portion 62.

Main portion 60 contains a liquid crystal display and a printed circuit board containing control circuitry. Main portion 60 also includes rear surface 64 which abuts portions 18*a–d* of frame portion 12 when ESL 40 is installed within mounting apparatus 10.

"Battery storage portion 62 further includes left and right retainers 74 and 76 which keep battery storage door 86 closed and which also retain ESL 40 within mounting apparatus 10."

Battery storage portion 62 further includes left and right retainers 74 and 76 which keep battery storage door 78 closed and which also retain ESL 40 within mounting apparatus 10.

Left and right retainers 74 and 76 include spring members 78 and 80 and latches 82 and 84.

Latches 82 and 84 retain battery storage portion 62 behind bottom portion 18b of frame portion 12. Spring members 78 and 80 sit on lip 20 when ESL 40 is installed.

First inward extending portion 28 includes apertures 36*a* and 36*b* through which latches 82 and 84 of ESL 40 extend.

Spring members 78 and 80 connect to a common center at the bottom of battery storage portion 62. Spring members 78 and 80 normally bias latches 82 and 84 to a position behind bottom portion 26*b* of frame portion 20.

Attachment of ESL 40 to mounting apparatus 10 is straightforward. Top edge 70 of battery storage portion 62 is inserted through aperture 42 with top portion 18*a* in channel 72. ESL 40 is then rotated towards aperture 42. Left and right retainers 74 and 76 are temporarily biased in an upwards direction to allow latches 82 and 84 to clear bottom portion 18*b* of frame portion 12. Left and right retainers 74 and 76 are then released to allow latches 82 and 84 to fall behind bottom portion 26*b* of frame portion 20.

Removal of ESL 40 proceeds in an opposite fashion.

Although the present invention has been described with particular reference to certain preferred embodiments thereof, variations and modifications of the present invention can be effected within the spirit and scope of the following claims. Mounting apparatus 10 may be made to different widths to accommodate mounting ESLs of different widths. Mounting apparatus 10 may also be formed to orient ESL 40 at other angles than those illustrated.

I claim:

1. An electronic shelf label mounting apparatus comprising:

a frame member including top, bottom, left, and right wall portions defining an enclosed aperture for receiving a rear portion of the electronic shelf label, wherein the wall portions include front surfaces for abutting against a front portion of the electronic shelf label, wherein the top wall portion includes a top edge, and wherein the bottom wall portion includes a bottom edge;

a top spring member extending behind the top edge;

a bottom spring member extending behind the bottom edge and in a normally biased position apart from the top spring member including a threaded aperture and first and second retaining apertures for receiving flexible bottom latches on extending downwardly from the rear portion of the electronic shelf label;

wherein the enclosed aperture is large enough for the rear portion and flexible bottom latches of the electronic shelf label to pass through only when the flexible bottom latches are biased in an upward position, wherein the top and bottom wall portions and the first and second retaining apertures prevent removal of the rear portion from the enclosed aperture when the flexible bottom latches are in an unbiased position extending downward through the first and second retaining apertures; and a screw which extends through the threaded aperture and against the top spring member to separate the top and bottom members by a minimum fixed distance from each other.

2. A mounting apparatus for an electronic shelf label comprising:

a frame member including a number of wall portions defining an enclosed aperture large enough for a rear portion of the electronic shelf label to pass through, wherein the wall portions include front surfaces for abutting against a front portion of the electronic shelf label, and wherein the frame member includes top and bottom edges;

a bottom spring member extending behind the bottom edge, wherein the bottom spring member includes first and second retaining apertures for receiving flexible bottom latches extending downwardly from the rear electronic shelf label; and a top spring member extending behind the top edge.

3. The electronic shelf label mounting apparatus as recited in claim 2, wherein the top and bottom spring members are normally biased apart.

4. The electronic shelf label mounting apparatus as recited in claim 2, wherein the bottom spring member has a threaded aperture for a screw and wherein the mounting apparatus further comprises a screw which extends through the threaded aperture and against the top spring member to separate the top and bottom members at a minimum fixed distance from each other.

5. The electronic shelf label mounting apparatus as recited in claim 2, wherein the top and bottom spring members include teeth for gripping a shelf channel.

6. The electronic shelf label mounting apparatus as recited in claim 2, wherein the enclosed aperture is large enough for the flexible bottom latches to pass through with the rear portion of the electronic shelf label only when the flexible bottom latches are biased in an upward position.

7. The electronic shelf label mounting apparatus as recited in claim 2, wherein the wall portions include top and bottom wall portions, and wherein the top and bottom wall portions and the first and second retaining apertures prevent removal of the rear portion from the enclosed aperture when the flexible bottom latches are in an unbiased position extending downward through the first and second retaining apertures.

* * * * *

UNITED STATES PATENT AND TRADEMARK OFFICE

CERTIFICATE OF CORRECTION

PATENT NO. : 6,698,701 B1
DATED : March 2, 2004
INVENTOR(S) : Dalton, G. C.

It is certified that error appears in the above-identified patent and that said Letters Patent is hereby corrected as shown below:

Column 4,
Line 5, after “latches” delete “on”.
Line 33, after “rear” insert -- portion of the --.

Signed and Sealed this

First Day of June, 2004

JON W. DUDAS
*Acting Director of the United States Patent and Trademark Office*